United States Patent [19]

Nishise

[11] Patent Number: 4,769,670

[45] Date of Patent: Sep. 6, 1988

[54] TRANSFER SHEET GUIDING DEVICE

[75] Inventor: Hideya Nishise, Toyohashi, Japan

[73] Assignee: Minolta Camera Kabushiki Kaisha, Osaka, Japan

[21] Appl. No.: 6,588

[22] Filed: Jan. 23, 1987

[30] Foreign Application Priority Data

Jan. 27, 1986 [JP] Japan ..... 61-15339

[51] Int. Cl.[4] ..... G03G 15/00; B65H 29/54

[52] U.S. Cl. ..... 355/3 SH; 355/3 R; 271/307

[58] Field of Search ..... 355/3 TR, 3 SH, 14 SH, 355/3 DR, 3 R; 271/92, 93, 306, 307, 311

[56] References Cited

U.S. PATENT DOCUMENTS 4,234,305 11/1980 Miyake et al. ..... 355/3 FU X

FOREIGN PATENT DOCUMENTS 52864 3/1985 Japan ..... 355/3 SH
212775 10/1985 Japan ..... 355/3 SH
200273 10/1985 Japan ..... 355/3 SH

*Primary Examiner*—A. T. Grimley
*Assistant Examiner*—Ed Pipala
*Attorney, Agent, or Firm*—Wenderoth, Lind & Ponack

[57] ABSTRACT

The present invention relates to a transfer sheet guiding device. The transfer sheet guiding device includes a separator for separating one lateral side of the transfer sheet from a photosensitive drum and a guiding plate for guiding the transfer sheet in a direction away from the photosensitive drum. The guiding plate extends in an adjustably inclined position with one lateral side thereof adjacent the separating means disposed at a level lower than the other lateral side thereof.

10 Claims, 3 Drawing Sheets

TRANSFER SHEET GUIDING DEVICE

BACKGROUND OF THE INVENTION

1. Field of the Invention

The present invention relates to a transfer sheet guiding device for use in electrophotographic imaging apparatus, and more particularly to a device for separating a transfer sheet from a photosensitive drum, the sheet bearing an image transferred thereto, and for guiding the sheet.

2. Description of the Prior Art

Generally in imaging apparatus utilizing electrophotography such as an electrophotographic copying apparatus, it is necessary to separate a transfer sheet from the photosensitive drum after a powder image formed thereon is transferred to the sheet. Separating means for this purpose include one for forcibly separating one lateral side of the transfer sheet from the drum.

FIG. 1 is a perspective view of a conventional separating device of the type mentioned above. Referenced by 101 in FIG. 1 is a photosensitive drum. A powder image formed on the drum 101 is transferred at the transfer position to a transfer sheet P fed to the drum 101, whereupon one lateral side of the sheet P is forcibly separated from the drum 101 by a separating belt 104. The transfer sheet P is then nipped at this separated side between rollers 105, 106 and is transported onto a guide plate 102. In this way, the transfer sheet P is completely separated from the photosensitive drum 101.

The separating device thus separates one lateral side of the transfer sheet P from the drum 101 and therefore fails to smoothly separate the other side of the sheet P from the drum side of the drum where no separating belt is provided. At this side where the separating belt 104 is not provided, the transfer sheet P tends to travel with the rotation of the drum 101 because such is attracted to the drum 101. Consequently, the other side of the sheet P becomes raised off the guide plate 102 as shown in FIG. 1, is positioned along the guide plate 102 later than the above-mentioned one side thereof and curls up. As the transfer sheet P is transported by the pair of separating rollers 105, 106 in this state, the rear end of the sheet P passes transported means for feeding the sheet P to the drum 101 (e.g. a pair of timing rollers), whereupon a force acting to eliminate the curl from the sheet P acts in a direction opposite to the direction of transport which results in the sheet P being transported obliquely.

If the transfer sheet P is thus fed to the fixing unit as curled, the sheet develops defects such as creases on fixing. Furthermore when the transfer sheet P is obliquely fed due to uncurling, the image transferred to the sheet P at the transfer position will be displaced or deformed.

The degree of curl of the transfer sheet varies with the ambient condition (e.g. humidity), the properties (e.g. strength) of the sheet, etc., consequently varying the obliqueness of transport of the sheet due to the curling. To obviate these defects, consideration needs to be given to every ambient condition, and the properties of the sheet, etc.

SUMMARY OF THE INVENTION

Accordingly, an object of the present invention is to provide a transfer sheet guiding device adapted to separate a transfer sheet at a lateral side thereof from a photosensitive drum and to transport the separated sheet stably and free from a state of obliqueness.

Another object of the present invention is to provide a transfer sheet guiding device for separating a transfer sheet from a photosensitive drum and transporting the separated sheet stably free from influences of ambient conditions and the properties of the sheet.

These and other objects are achieved by a transfer sheet guiding device which comprises means for separating one lateral side of a transfer sheet from a photosensitive drum, transport means for transporting the transfer sheet in a direction away from the photosensitive drum upon the separation of the lateral side by the separating means, a guide member provided downstream from the transport means with respect to the direction of transport of the sheet for guiding the transfer sheet while transported by the transport means, the guide member having a surface inclined upward from a side thereof close to the separating means toward the other side thereof, and means for varying the angle of inclination of the guide member surface.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numerals throughout the several drawings.

DETAILED DESCRIPTION OF THE INVENTION

Figure 1:
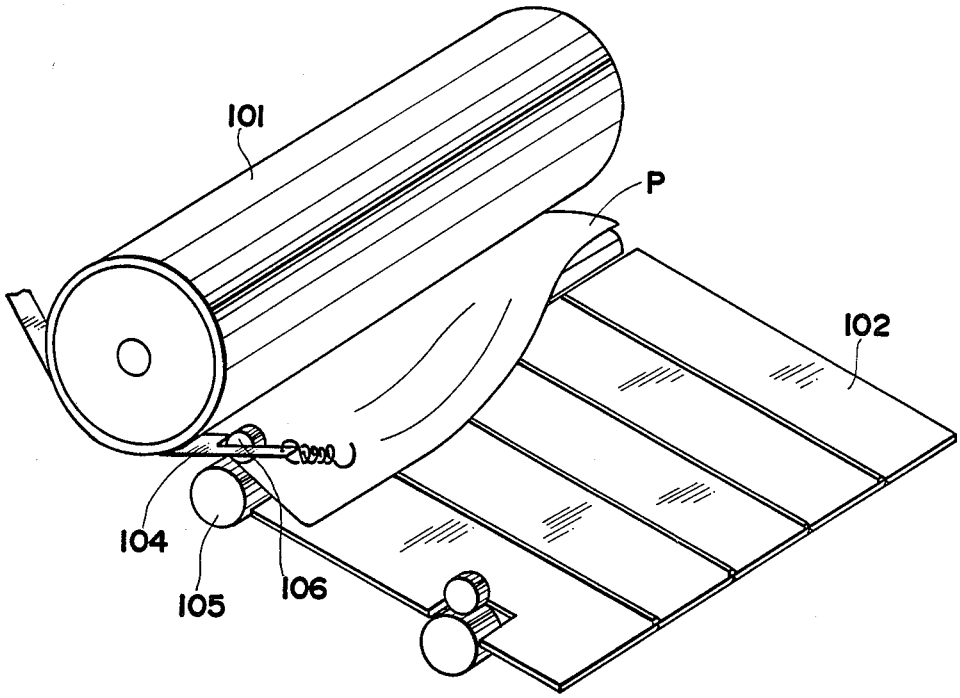
FIG. 1 Prior Art
FIG. 1 is a perspective view showing a conventional transfer sheet guiding device.
Figure 2:
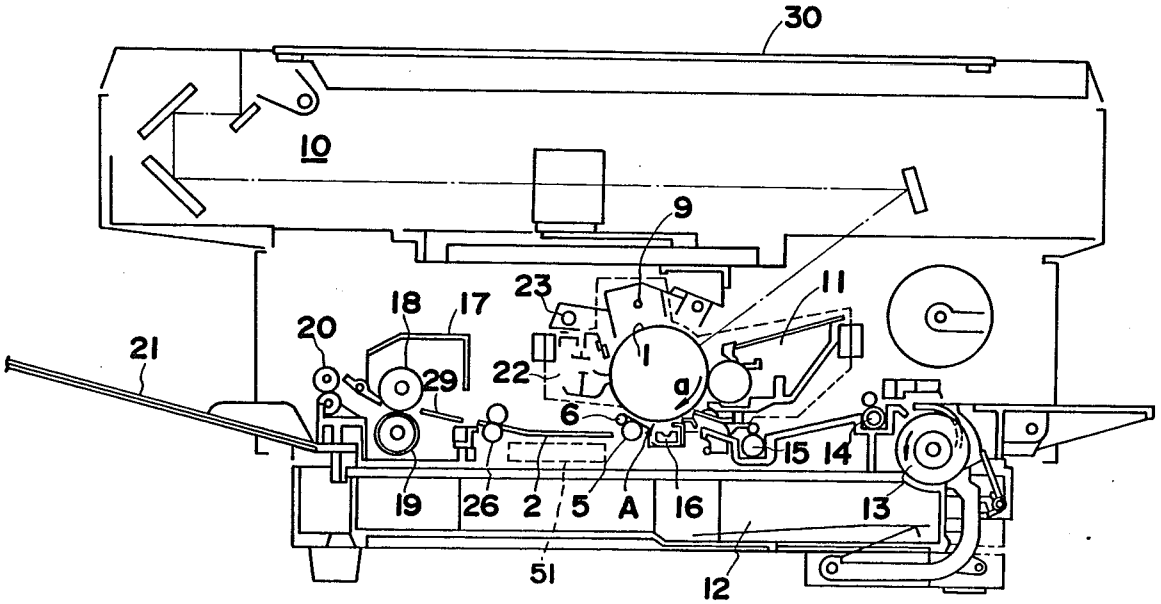
FIG. 2 is a sectional view of a copying machine incorporating a transfer sheet guiding device according to the present invention.

FIG. 2 shows the interior construction of a copying machine incorporating a transfer sheet guiding device embodying the invention.

The machine will be described generally with reference to the copying operation of the machine. The main body of the machine has at its approximate center, a photosensitive drum 1 which is drivingly rotatable in the direction of arrow a shown. The surface of the drum 1 is charged to a predetermined potential by a sensitizing charger 9 and is exposed at an exposure station to an image projected thereon from an optical system 10 scanning an original on a platen 30, whereby an electrostatic latent image is formed on the surface of the drum 1. The latent image is developed to a toner image by a magnetic brush developing unit 11.

On the other hand, transfer sheets P which are accommodated in a paper cassette 12 are dispensed one by one off of one another by a feed roller 13 rotating in a counterclockwise direction. Each sheet is reversed around the feed roller 13 and fed to a transfer station A by a pair of transport rollers 14 and a pair of timing rollers 15. At the transfer station A, a transfer charger 16 applies an electric field to the sheet P from below the sheet to transfer the toner image onto the sheet P. Although the transfer sheet P is brought into intimate contact with the drum 1 by the electric field at this time, the sheet P is separated from the drum 1 by a separating belt 4, transported over an inclined guide plate 2 to be described in detail below and a horizontal guide plate 29 in front of a fixing unit 17, and is transported into the fixing unit 17. In the unit 17, the toner image is fixed to the transfer sheet P by the heat of fixing rollers 18 and 19. The sheet P bearing the toner image fixed thereto is then delivered onto a tray 21 by a pair of discharge rollers 20.

A blade cleaner 22 removes the residual toner from the drum 1 which continues rotating in a clockwise direction. An eraser lamp 23 eliminates the residual charge from the drum 1.

Figure 3:
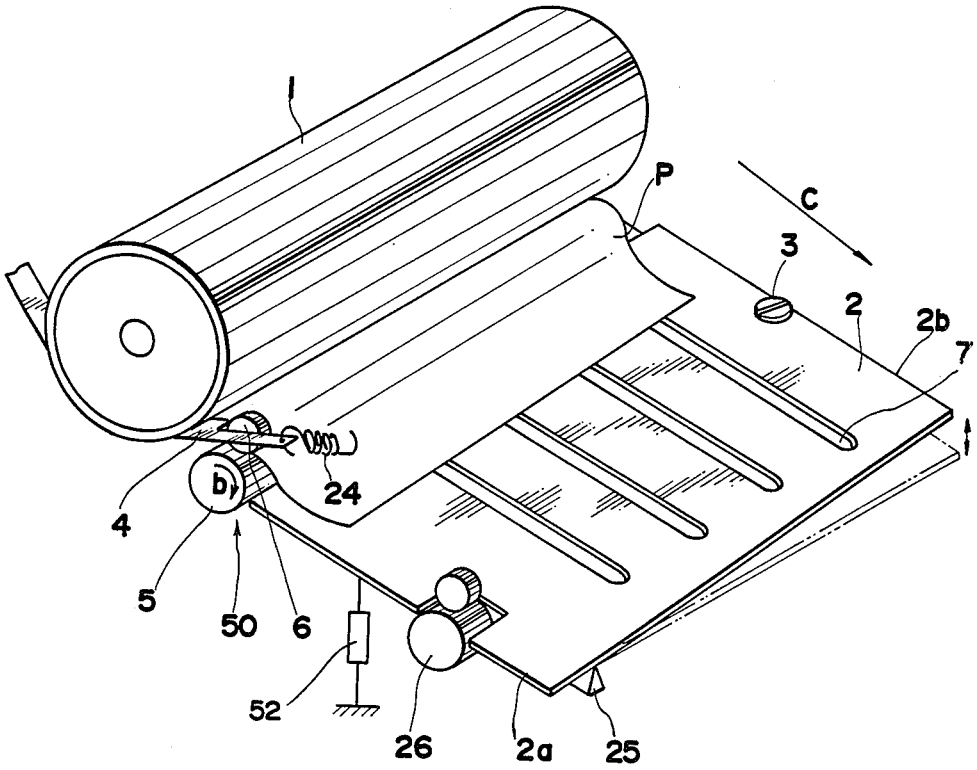
FIG. 3 is a perspective view showing the invention.

The device of the present invention will be described next with reference to FIG. 3.

The separating belt 4, which has the form of a film of polyester or the like, is fixed in position at one end by a pin (not shown) and is connected at the other end to a spring 24 so as to contact with one end of the photosensitive drum 1. Disposed in the vicinity of the end of the belt connected to the spring 24 are separating rollers 5 and 6 which are paired as at 50 for nipping the transfer sheet P at one lateral side thereof to transport the sheet P as the sheet is separated from the drum 1 by the separating belt 4. The roller 5 is drivingly rotated in the direction of arrow b shown, while the roller 6 is driven by the rotation of the roller 5. The guide plate 2 is provided downstream from the pair of rollers 5 and 6 with respect to the direction (indicated by an arrow c) in which the sheet is transported by these rollers. The guide plate 2 is supported, at one lateral side 2*a* close to the separating belt 4, by a fulcrum 25 and is pivotable about the portion of the fulcrum 25 contacting the plate 2. The other lateral side 2*b* of the guide plate 2 is supported by a mechanism 27 for adjusting the inclination of the guide plate 2, as will be described later, to a position disposed at a level higher than the side 2*a* close to the belt 4. Thus, the guide plate 2 is held in an adjustably inclined position with the side 2*a* thereof close to the belt 4 at a level disposed lower than the other side 2*b*. The guide plate 2 is formed with a plurality of suction openings 7 extending in the direction of transport of the transfer sheet P. The sheet P transported on the the guide plate 2 is attracted via the suction openings 7 to the plate 2 by suction means 51 provided below the guide plate 2. The sheet P is also electrostatically attracted to the guide plate 2 which is conductive and grounded via a resistor 52. The resistor 52 is provided to adjust the attracting force of the guide plate 2 to prevent sheet jamming. A pair of transport rollers 26 is provided in a recess formed in the side 2*a* of the guide plate 2 that is closed to the separating belt 4 to forward the sheet P toward the fixing unit 17.

Figure 4:
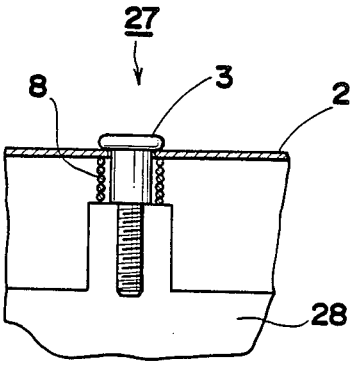
FIG. 4 is a sectional view of a mechanism 27 for adjusting the inclination of a guide plate 2 according to the present invention.

FIG. 4 is a sectional view showing the above-mentioned adjusting mechanism 27. An adjusting screw 3 extends through the guide plate 2 and is threaded in a frame 28 of the copying machine. A spring 8 is provided around the shank of the adjusting screw 3 and extends between the frame 28 and the guide plate 2 for pressing the guide plate 2 against the head of the screw 3. The adjusting screw 3, when loosened, permits the spring 8 to urge the lateral side 2*b* of the guide plate 2 upward to greatly incline the guide plate 2, whereas when tightened, the adjusting screw 3 depresses the guide plate side 2*b* against the force exerted by the spring 8 to reduce the inclination of the guide plate 2.

The transfer sheet guiding device having the construction described above operates in the following manner.

A transfer sheet P bearing a toner image transferred thereto at the transfer station and adhered to the photosensitive drum 1 by the transfer electric field has one lateral side separated from the drum 1 by the separating belt 4. The sheet P is then delivered onto the guide plate 2 with the separated side nipped between the separating rollers 5 and 6 and is thereby completely removed from the drum 1. At this time, the other side of the sheet P extends in an area at which a separating belt is not provided is therefore not readily separable, unlike the above-mentioned side extending in an area at which the separating belt 4 is provided, and tends to rise off the guide plate 2. However, the guide plate 2 is inclined with the side 2*b* of the plate 2 disposed at a level that is higher than the other side 2*a*, permitting the entire leading end of the sheet P to come into contact with the guide plate 2 at approximately the same time and consequently precluding the sheet P from curling. As a result, the transfer sheet P can be transported by a uniform force in the same direction over the entire width thereof.

The degree of rise of the transfer sheet P to be separated from the drum varies with the strength of the sheet P or an ambient condition such as humidity. For example, if the transfer sheet P, has low strength, it is not easily separable from the drum 1 and becomes greatly raised when it is to be separated, whereas if the sheet P has high strength it is readily separable from the drum 1 with a diminished rise. Furthermore in an environment of low humidity, the transfer sheet P is not smoothly separable and becomes raised markedly when it is to be separated from the drum, while an environment of high humidity permits the transfer sheet P to readily separated from the drum with a reduced rise. Thus, when the sheet P is to be separated from the drum, the transfer sheet P becomes raised to varying degrees depending on the strength of the sheet P, the ambient conditions, etc., and the inclination of the guide plate 2 is adjusted accordingly by the adjusting mechanism 27. This enables the leading end of the transfer sheet P to come into contact with the guide plate 2 at the same time over the entire width of the sheet, assuring separation and transport of the sheet P with good stability.

The transfer sheet P thus delivered onto the guide plate 2 is further transported by a pair of transport rollers 26, positioned horizontally on the horizontal guide plate 29 in front of the fixing unit 17, and is fed to the nip of the fixing rollers 18 and 19.

Although the present invention has been fully described by way of example with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. A transfer sheet guiding device for separating and transporting a transfer sheet from a photosensitive drum having a central axis, said device comprising:

means adjacent an end of the photosensitive drum for separating one lateral side of the transfer sheet from the photosensitive drum;

transport means for transporting the transfer sheet in a transport direction away from the photosensitive drum as the lateral side is separated by said separating means;

a guide member provided downstream of said transport means with respect to the transport direction of the sheet for guiding the transfer sheet as the sheet is transported by said transport means, said guide member having a surface inclined upward from one side thereof adjacent said separating means to the other side thereof with respect to a direction perpendicular to the transport direction of the sheet so that an angle of inclination is defined between said surface and the central axis of the photosensitive drum; and means for adjusting the angle of inclination at which said surface of said guide member is inclined relative to the central axis of the photosensitive drum.

2. A transfer sheet guiding device according to claim 1, wherein said guide member is a plate; and said adjusting means includes, a supporting means for pivotally supporting said guide member at said one side thereof adjacent said separating means, and an adjusting mechanism provided at said other side for adjusting the inclination of said guide member about said supporting means.

3. A transfer sheet guiding device according to claim 2, wherein said separating means is a separating belt which is in contact with one end of the photosensitive drum.

4. A transfer sheet guiding device according to claim 3, wherein said guide member is conductive for attracting the transfer sheet thereto, and has a resistor connected thereto through which the guide member is grounded.

5. A transfer sheet guiding device according to claim 3, and further comprising suction means provided below said guide member, and wherein said guide member has a plurality of openings extending therethrough and through which the transfer sheet is attracted to said guide member by said suction means.

6. A transfer sheet guiding device for separating and transporting a transfer sheet from a photosensitive drum having a central axis, said device comprising:

means adjacent an end of the photosensitive drum for separating one lateral side of the transfer sheet from the photosensitive drum;

transport means for transporting the transfer sheet in a transport direction away from the photosensitive drum as the lateral side is separated by said separating means;

a guiding plate provided downstream of said transport means with respect to the transport direction of the sheet, and including a planar surface with parallel lateral sides for guiding the transfer sheet as it is transported by said transport means;

supporting means for supporting said guiding plate in an inclined position at which one of said lateral sides thereof adjacent to said separating means is disposed at a level that is lower than a level at which the other lateral side thereof is disposed; and means for varying the inclination of said guiding plate.

7. A transfer sheet guiding device according to claim 6, wherein said supporting means pivotally supports said guiding plate, and said varying means for varying the inclination of said guiding plate comprises means for adjusting the position of said guiding plate about said supporting means.

8. A transfer sheet guiding device according to claim 7, wherein said supporting means pivotally supports said guiding plate at a position proximate to said one lateral side adjacent to said separating means, and said varying means varies the level at which the other lateral side thereof is disposed for adjusting the inclined position of said guiding plate.

9. A transfer sheet guiding device according to claim 8, wherein said separating means is a separating belt which is in contact with one end of the photosensitive drum.

10. A transfer sheet guiding device according to claim 9, wherein said guiding plate is conductive for attracting the transfer sheet to said guiding plate, and has a resistor connected thereto through which the guiding plate is grounded.

* * * * *